US006032326A

United States Patent [19]

Roden et al.

[11] Patent Number: 6,032,326

[45] Date of Patent: Mar. 7, 2000

[54] SURFACE CLEANING APPLIANCE

[75] Inventors: Michael J. Roden, Prescott; Steven S. Wickert, Prescott Valley, both of Ariz.

[73] Assignee: Professional Chemicals Corporation, Chandler, Ariz.

[21] Appl. No.: 09/187,971

[22] Filed: Nov. 6, 1998

[51] Int. Cl.[7] ..... A47L 11/20

[52] U.S. Cl. ..... 15/320; 15/385

[58] Field of Search ..... 15/320, 322, 354, 15/359, 380, 385

[56] References Cited

U.S. PATENT DOCUMENTS

| | | | |
|---|---|---|---|
| 928,456 | 7/1909 | Johnson | 15/385 |
| 2,973,544 | 3/1961 | Romaniuk | 15/359 |
| 3,624,668 | 11/1971 | Krause . | |
| 4,107,816 | 8/1978 | Matthews | 15/322 |
| 4,339,840 | 7/1982 | Monson . | |
| 4,441,229 | 4/1984 | Monson . | |
| 4,991,254 | 2/1991 | Roden et al. . | |
| 5,463,791 | 11/1995 | Roden . | |
| 5,826,298 | 10/1998 | Rohrbacher et al. | 15/385 |

*Primary Examiner*—Terrence R. Till
*Attorney, Agent, or Firm*—Cahill, Sutton & Thomas P.L.C.

[57] ABSTRACT

The vacuum nozzles in a rotary surface cleaning appliance are skewed with respect to the path of travel of the nozzles to enable the nozzles to glide smoothly over the surface being cleaned. A flexible mount for each nozzle on a rigid, radial vacuum duct permits the nozzle to accommodate irregular and different textured surfaces being cleaned.

6 Claims, 3 Drawing Sheets

SURFACE CLEANING APPLIANCE

TECHNICAL FIELD

This invention is concerned with improving apparatus for cleaning a surface, such as a carpet, by spraying a cleaning fluid onto the surface and vacuuming up the fluid and debris from the surface.

BACKGROUND ART

A variety of apparatus for carrying out this cleaning technique have been devised in the past. The simpler systems utilize a hand-held wand with one spray nozzle and one vacuum nozzle, as disclosed in U.S. Pat. No. 4,991,254, granted to James R. and Michael J. Roden on Feb. 12, 1991 for "CLEANING SYSTEM". More complex systems may employ a motor-driven rotating head with multiple spray nozzles and multiple vacuum nozzles. An example of the latter apparatus is described in U.S. Pat. No. 4,339,840 granted Jul. 20, 1982, to Clifford L. Monson for "ROTARY FLOORING SURFACE TREATING DEVICE". That same inventor was granted U.S. Pat. No. 4,441,229 on Apr. 10, 1984 for similar apparatus entitled "ROTARY CLEANER-POLISHER". U.S. Pat. No. 3,624,668 granted Nov. 30, 1971 to H. W. Krause for "RUG CLEANING AND RINSING DEVICE" discloses a similar appliance.

One undesirable operating characteristic of rotary single head cleaning devices is their tendency to veer off in different directions, depending upon the handling forces that are applied. Control of the heavy, commercial device of, say, 70–80 pounds, can be difficult and tiring for the operator.

Further, the vacuum nozzles in these devices have a tendency to chatter along the surface being cleaned and can be quite noisy in operation.

The handling characteristics of this type apparatus can be improved by employing two, counter-rotating head structures. As an example of this apparatus see U.S. Pat. No. 5,463,791 granted Nov. 7, 1995 to Michael J. Roden for "SURFACE CLEANING APPLIANCE".

There continues to be a need for a smooth running, quiet and effective cleaning appliance.

SUMMARY OF THE INVENTION

In prior cleaning appliances the elongated vacuum nozzles in contact with the surface to be cleaned have been positioned with their longitudinal axes radially disposed in the rotating head. (See the aforementioned Monson '229 patent.) In the present invention the longitudinal axes of the vacuum nozzles are skewed slightly with respect to radii of the path of travel of the vacuum nozzles. With the nozzle axes at only acute angles to these radii the nozzles move smoothly across the surface eliminating the chattering of prior nozzles.

Further, in accordance with this invention each vacuum nozzle is flexibly connected to a substantially rigid vacuum duct allowing the vacuum nozzles to move to accommodate irregularities and texture differences in the surface being cleaned.

BRIEF DESCRIPTION OF THE DRAWINGS

The invention is described in greater detail hereinafter by reference to the accompanying drawings wherein.

BEST MODE FOR CARRYING OUT THE INVENTION

Figure 1:
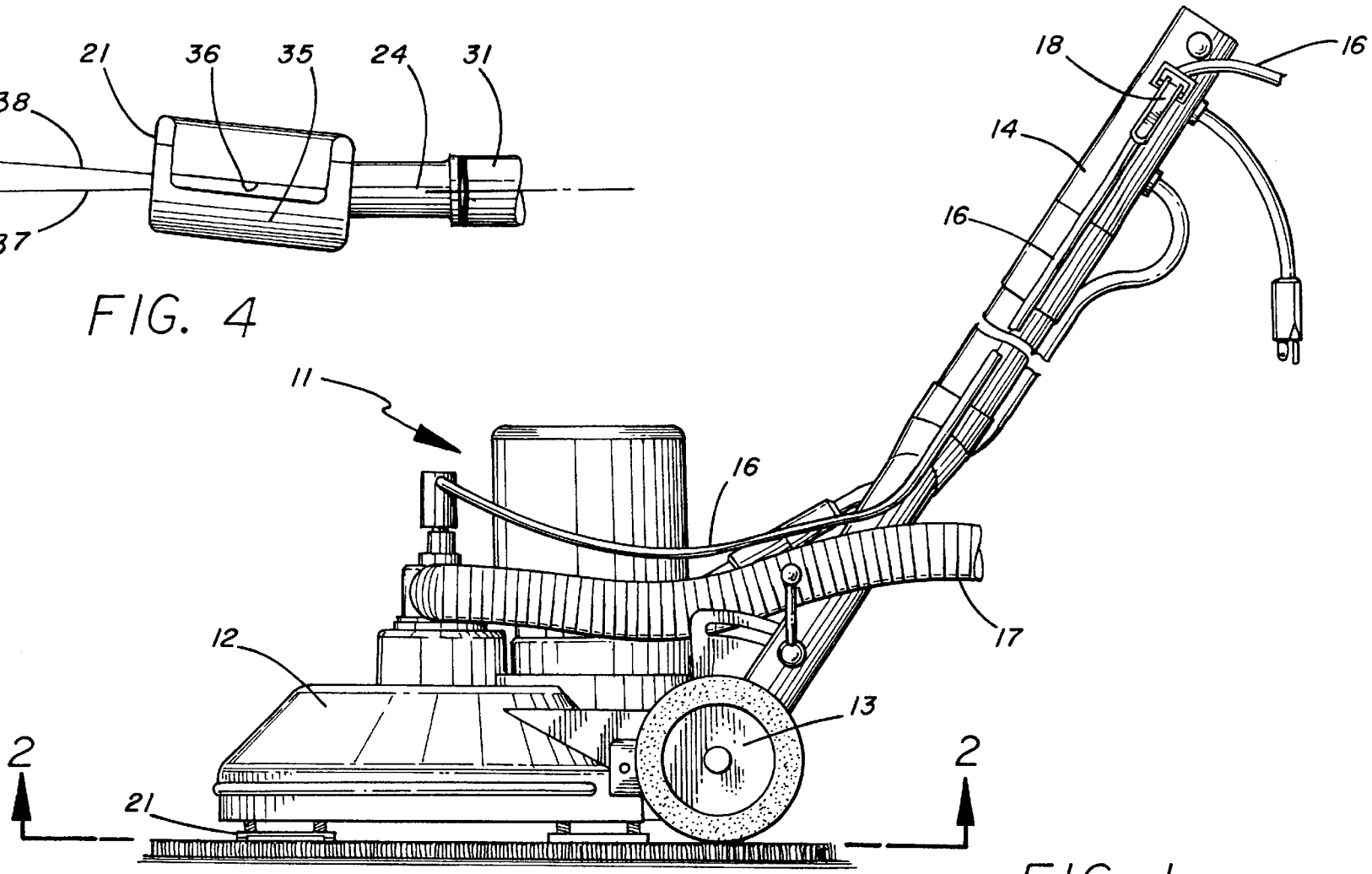
FIG. 1 is a side elevational view of a carpet cleaning appliance embodying the invention.

Referring particularly to FIG. 1, the numeral 11 designates generally the surface cleaning appliance of this invention. The appliance comprises a housing 12 mounted on wheels 13 for movement across the surface, such as a rug, to be cleaned. The appliance is manipulated by means of a handle 14 hingedly attached to the housing 12.

Extending along the handle 14 is a hose 16 which carries pressurized cleaning fluid, preferably a heated liquid mixture of water and a detergent, to the appliance housing 12. The flow of cleaning fluid through hose 16 is controlled by a hand-manipulated valve 18 on the handle 14. Another hose 17 is a vacuum hose and is considerably larger in diameter than hose 16 so that it can carry a mixture of air, spent cleaning fluid and debris vacuumed from the surface being cleaned.

Hoses 16 and 17 are connected, respectively, to sources of cleaning fluid under pressure and a vacuum, neither of which are shown. Such sources may, for example, comprise the system shown and described in the aforementioned Roden et al. '254 patent.

The physical act of cleansing a surface is accomplished by a rotating head 19 mounted in housing 12 for rotation about a vertical axis. The head comprises a plurality of vacuum nozzles 21 and a plurality of spray nozzles 22.

Spray nozzles 22 receive heated cleaning fluid from a manifold 23 which is connected to cleaning fluid hose 16. Nozzles 22 spray the cleaning fluid onto the surface being cleaned and the vacuum nozzles 21 vacuum up spent cleaning fluid and loosened debris.

This invention is concerned primarily with the performance of the vacuuming portion of the head 19, i.e., the support and disposition of the vacuum nozzles 21.

Figures 3, 5:
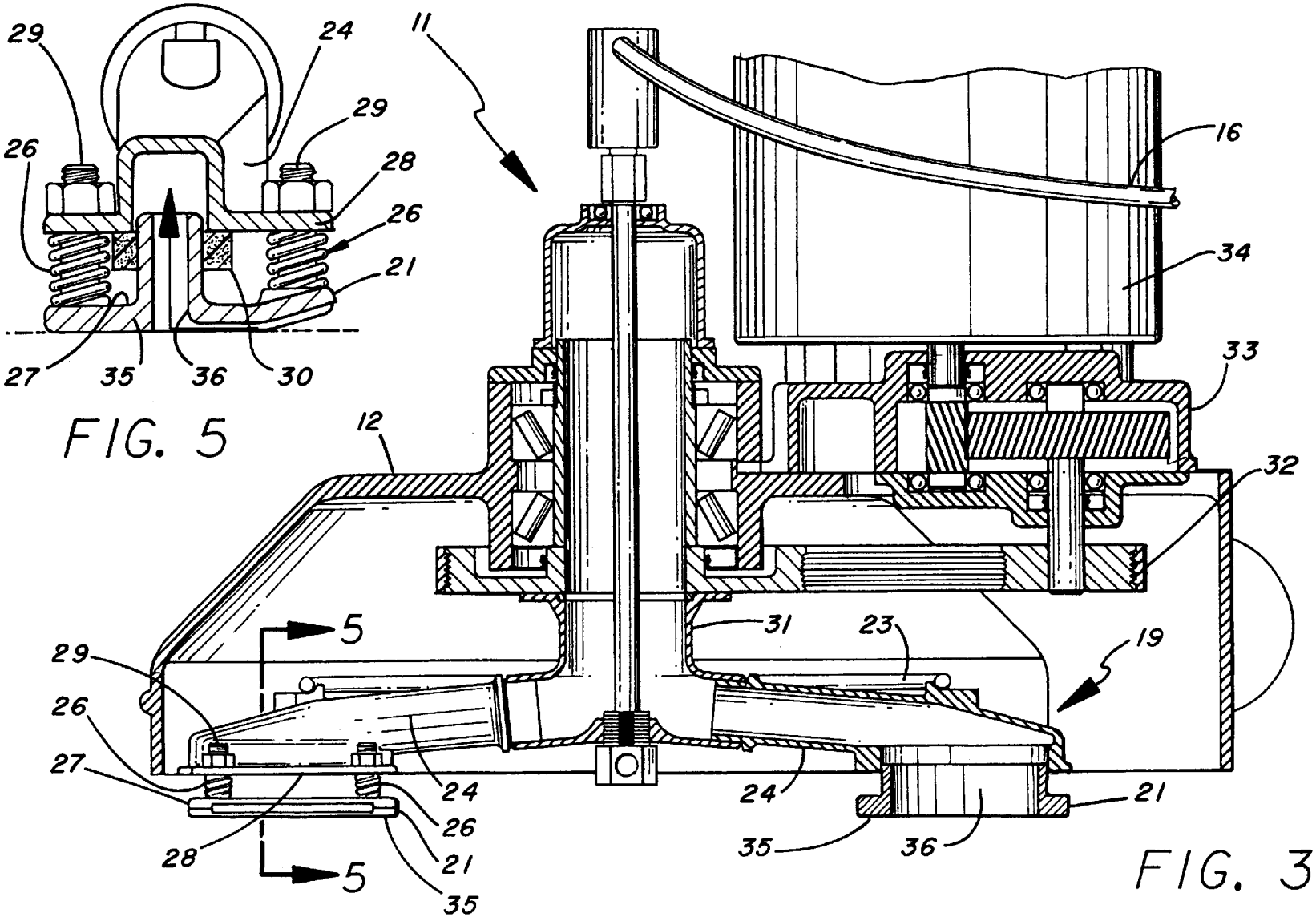
FIG. 3 is a vertical sectional view taken generally as indicated by line 3–3 in FIG. 2.
FIG. 5 is a vertical sectional view through one of the vacuum nozzles taken generally as indicated by line 5–5 in FIG. 3.

Each vacuum nozzle 21 is flexibly mounted on the end of a relatively rigid, radially disposed vacuum duct 24. The mounting preferably takes the form of springs 26 between flange regions 27 on vacuum nozzles 21 and flange regions 28 on the vacuum ducts 24. (See FIGS. 3 and 5). Threaded studs 29 passing through these components complete the connections. The connection permits resilient up and down movement of each vacuum nozzle 21 inside the end of its vacuum duct 24. A seal 30 at the junction between each nozzle 21 and its vacuum duct 24 assures an air tight connection between the two.

Each vacuum duct 24 is carried by and in communication with a rotatable vacuum manifold 31. Manifold 31 is rotated by a belt drive 32 from a reduction gear 33 associated with an electric motor 34 and mounted on the upper deck of housing 12.

Each vacuum nozzle 21 has a surface contacting region 35 which forms an elongated opening 36.

Figure 4:
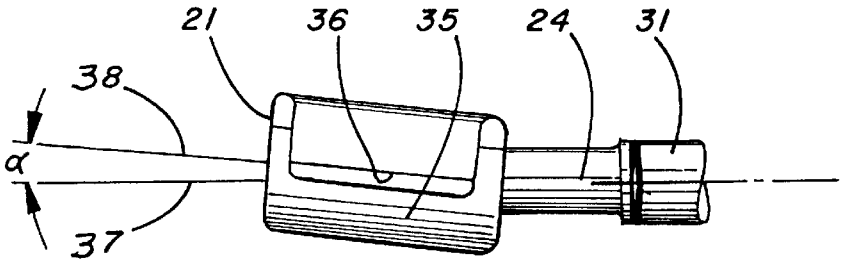
FIG. 4 is a view of the underside of one of the vacuum nozzles illustrating how its longitudinal axis is skewed with respect to a radius of the rotatable head.
Figure 2:
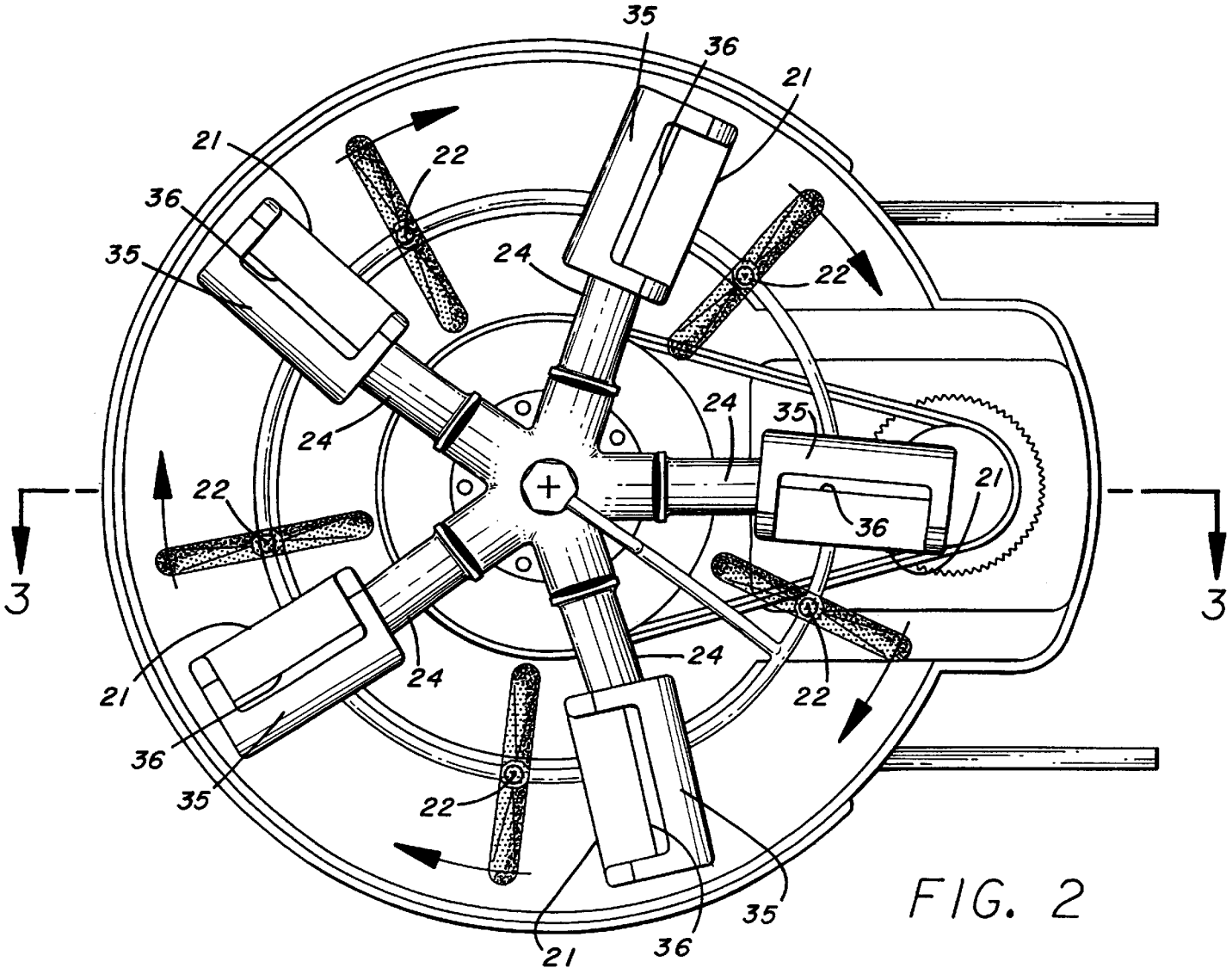
FIG. 2 is a view of the underside of the appliance taken generally as indicated by line 2—2 in FIG. 1 (certain components, such as wheels and handle have been omitted)

Unlike prior rotary cleaning apparatus the elongated surface contacting region 35 and opening 36 in each vacuum nozzle 21 are not radially disposed in the cleaning head 19. In accordance with this invention each vacuum nozzle 21 is skewed with respect to a radius of the path of travel of the vacuum nozzle. Note FIG. 4 particularly in which dot-dash line 37 represents a radius of the path of nozzle 21 travel and dot-dash line 38 represents the center line of the longitudinal surface contacting region 35 and opening 36 in a nozzle 21. The displacement is an acute angle which can be as little as five degrees. And the skew is in a direction which causes the outer edge of the surface contacting region 35 of each vacuum nozzle 21 to lead the inner edge of the surface contacting region of the nozzle.

The skewed disposition of the vacuum nozzles 21 with respect to their path of travel has two beneficial effects. First, the nozzles 21 glide more smoothly over the surface being cleaned. The tendency to chatter like prior appliances is virtually eliminated. And, of course, the flexible mounting of the nozzles 21 on the springs 26 permits the nozzles 21 to accommodate irregularities and texture differences in the surface being cleaned.

The second beneficial effect attributed to the skewed nozzles 21 is that the nozzles 21 tend to sweep cleaning fluid on the surface being cleaned toward the center of the rotating head 19. This is to be contrasted with the effect of radially disposed nozzles which tend to sling the cleaning fluid outwardly from the appliance.

From the foregoing it should be apparent that this invention improves the performance of rotary surface cleaning appliances. Although the invention has been described by reference to an appliance having a single cleaning head, it should be obvious that the invention is equally applicable to and beneficial for appliances with more than one rotating head.

What is claimed is:

1. In a rotary surface cleaning apparatus, a rotatable vacuum manifold, a vacuum duct in communication with said manifold and extending outwardly therefrom, and a vacuum nozzle carried by said duct and in communication therewith, the arrangement being such that when said manifold is rotated said vacuum nozzle is moved over the surface being cleaned in a circular path, and said vacuum nozzle having an elongated surface contacting region providing an elongated opening therein, the surface contacting region of the vacuum nozzle being disposed at an acute angle with respect to a radius of the path of travel of the vacuum nozzle.

2. The apparatus of claim 1 wherein said vacuum duct is a substantially rigid member and a flexible connection is provided between said vacuum duct and said vacuum nozzle.

3. The apparatus of claim 1 wherein there are a plurality of vacuum ducts extending outwardly from the vacuum manifold and a like number of vacuum nozzles carried by the vacuum ducts.

4. The apparatus of claim 3 wherein there is a flexible connection between each vacuum duct and the vacuum nozzle carried thereby.

5. The apparatus of claim 4 further comprising means carried by said vacuum ducts for depositing cleaning fluid onto the surface to be cleaned between said vacuum nozzles.

6. The apparatus of claim 5 wherein said depositing means are spray nozzles.

* * * * *